US007063365B1

(12) United States Patent
Chase

(10) Patent No.: US 7,063,365 B1
(45) Date of Patent: Jun. 20, 2006

(54) PET WASTE PICK-UP DEVICE

(76) Inventor: Kent B. Chase, 1738 Sheridan St., Madison, WI (US) 53704

( * ) Notice: Subject to any disclaimer, the term of this patent is extended or adjusted under 35 U.S.C. 154(b) by 192 days.

(21) Appl. No.: 10/609,943

(22) Filed: Jun. 30, 2003

Related U.S. Application Data

(60) Provisional application No. 60/393,336, filed on Jul. 2, 2002.

(51) Int. Cl.
*A01K 29/00* (2006.01)

(52) U.S. Cl. ..... 294/1.3; 294/115

(58) Field of Classification Search ..... 294/1.3, 294/1.4, 16, 19.1, 50.8, 55, 100, 106, 115; 15/104.8
See application file for complete search history.

(56) References Cited

U.S. PATENT DOCUMENTS

| | | | | |
|---|---|---|---|---|
| 3,093,402 | A * | 6/1963 | Sisson | 294/19.1 |
| 3,716,263 | A | 2/1973 | Gatti | |
| 3,733,098 | A | 5/1973 | Tobias | |
| 3,929,363 | A * | 12/1975 | Kahan | 294/1.4 |
| 4,014,584 | A | 3/1977 | Bau | |
| 4,017,015 | A | 4/1977 | Jefferson | |
| 4,103,952 | A | 8/1978 | Thompson | |
| 4,179,145 | A | 12/1979 | Shinsako | |
| 4,194,777 | A | 3/1980 | Carns | |
| 4,225,174 | A | 9/1980 | Hennessy et al. | |
| 4,247,139 | A | 1/1981 | Grieb | |
| 4,248,468 | A | 2/1981 | Hastings | |
| 4,323,272 | A | 4/1982 | Fortier | |
| 4,477,111 | A | 10/1984 | Crooks | |
| 4,741,566 | A | 5/1988 | Byung-Do et al. | |
| 4,744,596 | A * | 5/1988 | Hiller et al. | 294/88 |
| 4,830,419 | A | 5/1989 | Watanabe | |
| 4,869,204 | A | 9/1989 | Yananton | |
| 4,951,987 | A | 8/1990 | Lebeau | |
| 5,056,842 | A | 10/1991 | Lindenberg et al. | |
| 5,149,159 | A | 9/1992 | Bardes | |
| 5,335,952 | A | 8/1994 | Clapper | |
| 5,350,208 | A | 9/1994 | Heinrichson | |
| 5,476,296 | A | 12/1995 | Gross | |
| 5,503,442 | A * | 4/1996 | Lee | 294/1.4 |
| 5,564,762 | A | 10/1996 | Ring | |
| 5,601,321 | A | 2/1997 | Simon | |
| 5,620,220 | A | 4/1997 | Khoshnood | |
| 5,628,537 | A | 5/1997 | Kiemer | |
| 5,868,447 | A | 2/1999 | Clark et al. | |
| 5,890,229 | A | 4/1999 | Esposito | |
| 6,135,520 | A | 10/2000 | Miller et al. | |
| 6,330,721 | B1 | 12/2001 | Wallace et al. | |

* cited by examiner

*Primary Examiner*—Dean J. Kramer
(74) *Attorney, Agent, or Firm*—Craig A. Fieschko, Esq.; DeWitt Ross & Stevens S.C.

(57) ABSTRACT

A pet waste collection device has a pair of opposing jaws movable between a closed jaw state and an open jaw state, and a liner bag may be situated about the jaws so that closure of the jaws about pet waste encases the waste within a bag. The jaws do not simply pivot into a closed state, and rather they travel toward each other in a path substantially parallel to the surface upon which the waste rests to close about the waste, and they then retract. Opposing shells which open and close about the jaws may strip the bag from the jaws when the jaws are closed about the waste.

23 Claims, 13 Drawing Sheets

FI. 9b

FIG. 10a
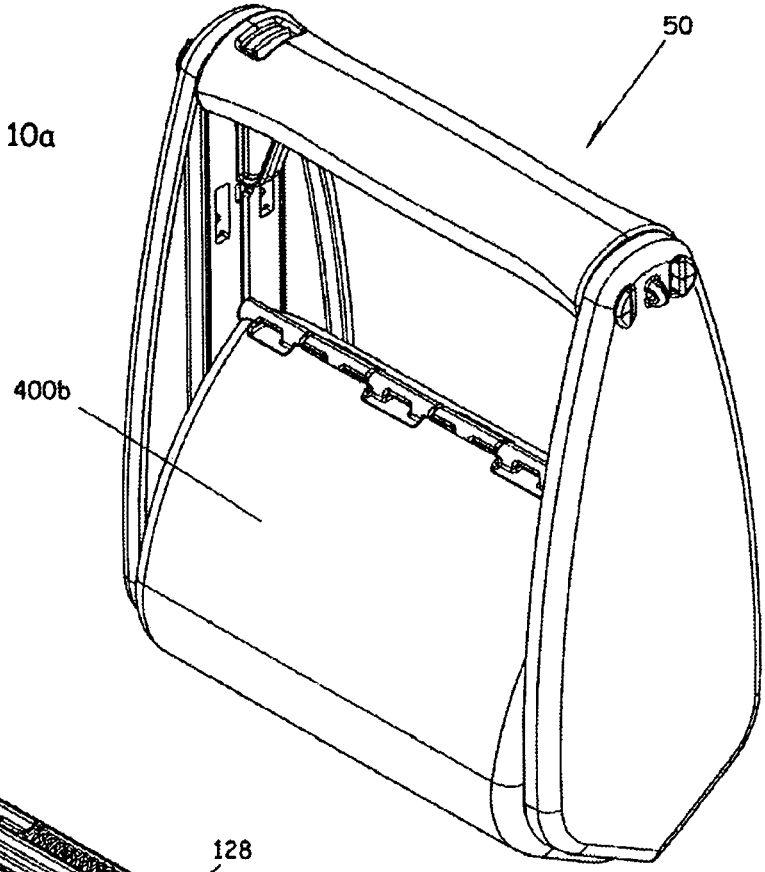
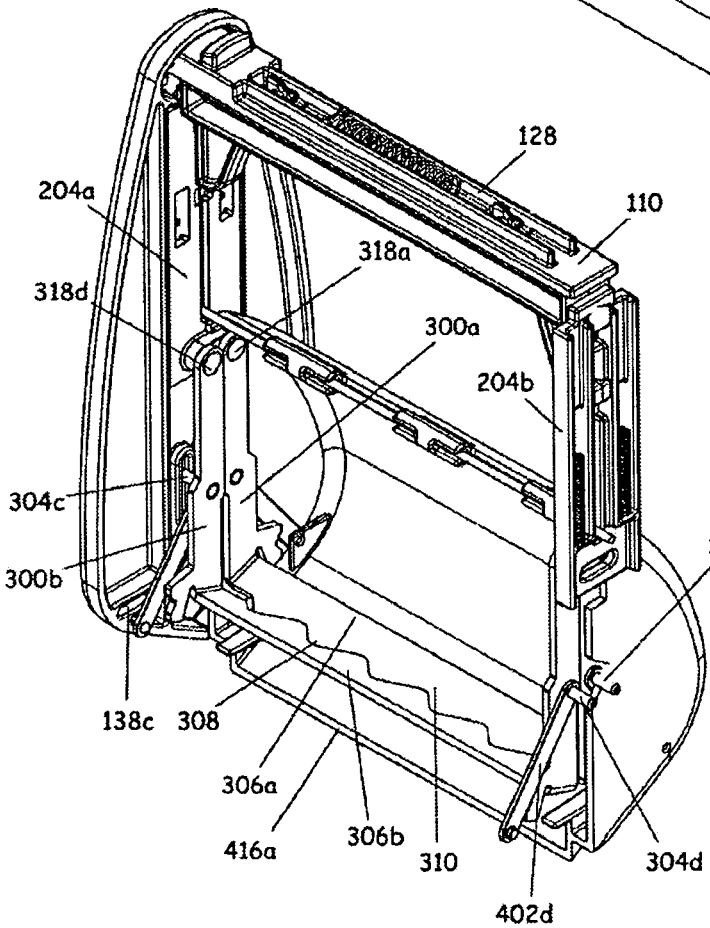
FIG. 10b

FIG. 11a
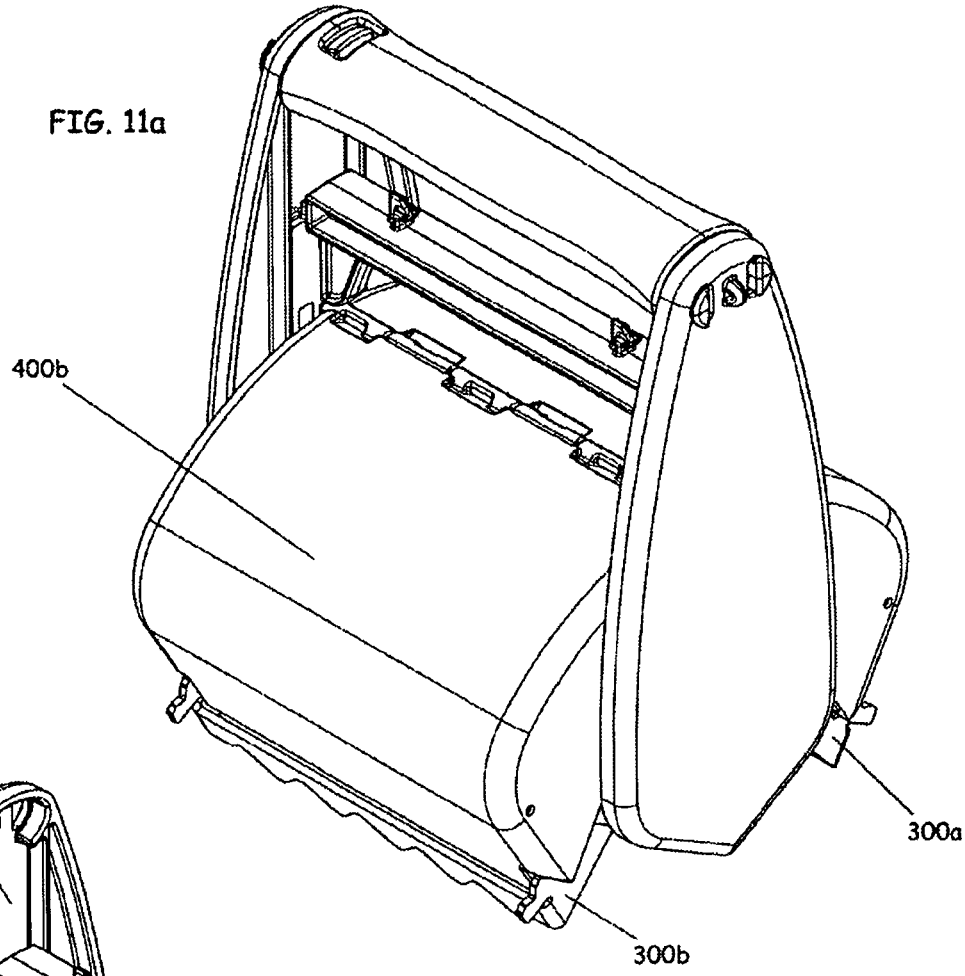
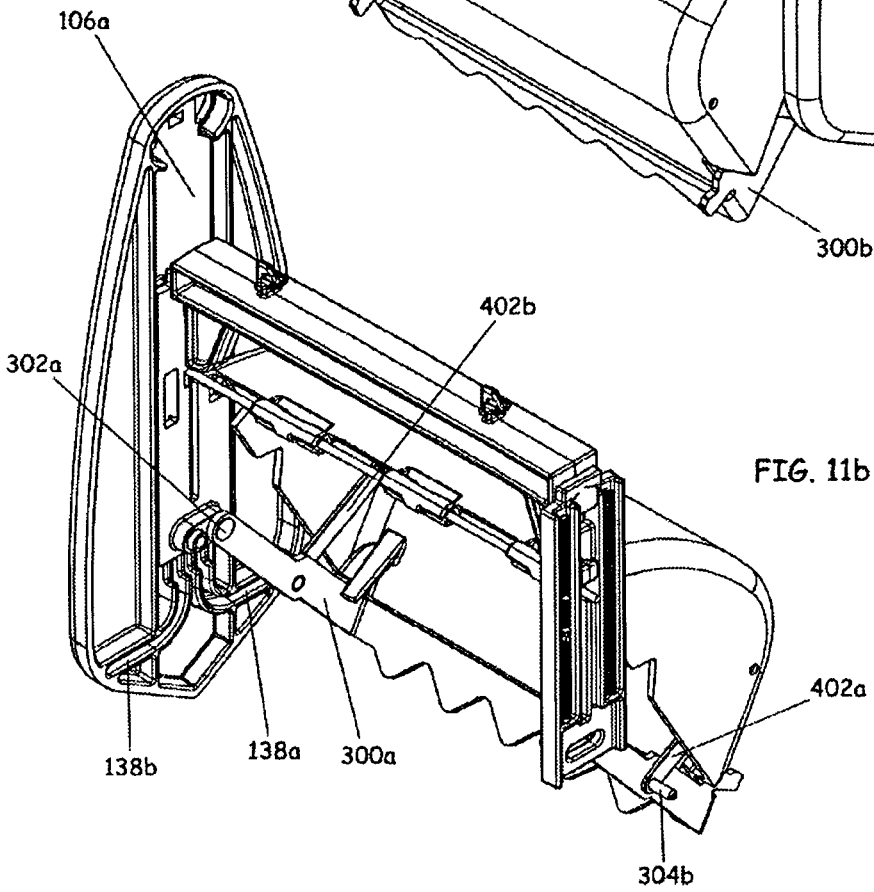
FIG. 11b

PET WASTE PICK-UP DEVICE

CROSS-REFERENCE TO RELATED APPLICATIONS

This application claims priority under 35 USC §119(e) to U.S. Provisional Patent Application 60/393,336 filed Jul. 2, 2002, the entirety of which is incorporated by reference herein.

FIELD OF THE INVENTION

This disclosure concerns an invention relating generally to devices and methods for picking up dog or other solid pet waste and, more particularly, to devices which may be manually manipulated to pick up and dispose of animal waste in a container and to a method of utilizing such devices with no or minimal manual contact with the waste-holding container.

BACKGROUND OF THE INVENTION

Recently there has been much adverse criticism of dog owners for allowing their dogs to deposit their droppings in public places and on the property of other persons. Effective retrieval of pet waste, dog feces in particular, is a matter of considerable concern due to possible public health risks created by the resultant unsanitary conditions, not to mention the general inconvenience to the public. In some locations, legislation has been enacted which requires dog owners to not only clean up after their pet in any public area, but also to actually carry an approved device for performing the clean up task. As more and more communities pass ordinances and levy fines on pet owners for failure to adequately collect and dispose of their pet's waste, the need for a simple, clean, efficient method of compliance is clearly demonstrated. It should be noted that the method of compliance must accomplish more than just efficient, effective performance of the required task. Transporting pet waste is a decidedly unpleasant and undignified task. This fact is evidenced by minimal compliance with existing ordinances. Any device that attempts to solve this problem must also address these issues. They can be addressed by carefully considering the form of the device. Dignity can be restored by means of an aesthetically pleasing device. The success of regulations requiring the collection and disposal of pet waste, in order to be practically enforceable, therefore, depends upon the availability of a device which is inexpensive, is effective in collecting and disposing of the waste in a facile manner, permits the disposal of the collected waste in a closed disposable container which the owner need never come in contact with after the waste has been collected, and which maintains the dignity of the user. In such instances it was previously necessary to resort to rather cumbersome methods for retrieving pet waste in a sanitary manner which would be unoffensive to the user.

Current methods are of four distinct types. The first type includes devices having cooperating jaws at the lower end of a cane-like handle which accommodate a disposable container or bag, as in U.S. Pat. Nos. 5,620,220; 5,335,952; 4,477,111; 4,247,139; 4,179,145; 4,014,584; and 3,733,098. In addition, the bag or container may be automatically sealed and/or automatically ejected by the device. Distinct disadvantages associated with these devices relate to jaw operation and handle length. These prior art devices generally utilize a pair of jaws that pivot about a common axis. In such an arrangement the end of the jaws responsible for scooping up the pet waste travels in an arc. Effective retrieval of pet waste requires that the jaws remain in contact with the ground during use. Because the jaws travel in an arc the device must be carefully manipulated in order for the jaws to maintain contact with the ground as the waste is being retrieved. Another distinct problem relates to handle length. Most of these prior art devices utilize a long handle. This type of handle, while intended to allow the user to operate the device at a distance from the pet waste, so as to minimize contact with unpleasant odors, also makes operation difficult. As handle length increases the dexterity required of the user to manipulate the device increases. Devices with long handles also make transportation of the device cumbersome. These devices also suffer from several general disadvantages. Many of these devices are complex in their construction and still require the user to remove the sealed bag or container by hand. This operation is distasteful to many people and discourages the use of such devices however effective they might be in the actual collection of the excrement. In general, devices of this type include numerous structural elements, linkages, complicated construction and operation and increased fabrication and assembly costs. In practice these prior art devices are quite difficult to manipulate effectively and the manner of operation results in incomplete retrieval of the pet waste and/or unintended smearing of pet waste on the device.

A variation of the first type of device utilizes a scoop and bag arrangement that is forcibly slid beneath a given dropping, as in U.S. Pat. Nos. 6,135,520; 5,868,447; and 4,741,566. Some of these devices utilize a paddle-like closure that pulls the waste into the bag. In both instances the open rim of the bag as well as the paddle closure become soiled during operation. These devices must then be carefully cleaned of the residue of the collected waste before they are stored or it will result in offensive odors and dirt being brought inside from outdoors. In addition, none of these devices provide for automatic sealing or disposal of the bag.

The second type includes devices having cooperating jaws at the lower end of a cane-like handle without any type of disposable container or bag, as in U.S. Pat. Nos. 5,601,321; 4,951,987; and 4,248,468. The primary disadvantage of these devices is that they must be carefully cleaned of the residue of the collected waste before they are stored or it will result in offensive odors and dirt being brought inside from outdoors.

The third type includes devices that consist of a container for retaining the pet waste and a separate instrument or tool of some kind for guiding the pet waste into the container, as in U.S. Pat. Nos. 5,564,762; 4,830,419; 4,103,952; and 4,017,015. Such devices are often bulky and awkward making transport and handling quite difficult. Moreover, use of such devices entails difficult cleaning problems and accordingly, devices of this type are objectionable from an aesthetic as well as functional standpoint.

The fourth type includes ordinary plastic bags as commonly used in grocery stores. While this is arguably the most commonly used device, it is also one of the most objectionable. The user must come into direct tactile and olfactory contact with the pet waste, a most unpleasant prospect. In addition, the bag requires careful handling until a suitable waste receptacle is located.

None of the currently available devices or methods that are known is as satisfactory as the invention disclosed herein. This device fills a need as it provides an aesthetically pleasing, easily operated device which eliminates contact with the pet waste by the owner and the reusable portion of the device, while collecting and packaging the pet waste in a sealable container for convenient disposal.

SUMMARY OF THE INVENTION

The invention, which is defined by the claims set forth at the end of this document, is directed to devices which at least partially alleviate the aforementioned problems. A basic understanding of some of the preferred features of the invention can be attained from the following brief review of a preferred version of the invention, with more details being provided elsewhere in this document.

Looking, for example, to FIGS. 17*a*–17*c* for a depiction of the structure and operation of a preferred pet waste collection device 50, a pair of opposing jaws 300*a* and 300*b* are movable between a closed jaw state (FIG. 17*c*) with their jaw ends 306*a* and 306*b* proximate each other, and an open jaw state (FIG. 17*a*) wherein the jaw ends 306*a* and 306*b* are spaced from each other. A liner bag 500 may be situated between the jaws with its mouth fit about the jaw ends 306*a* and 306*b*, such that the bag 500 effectively forms the "throat" of the jaws 300*a* and 300*b* and the mouth of the bag 500 opens and closes with the jaws 300*a* and 300*b*. Thus, if the jaws 300*a* and 300*b* are closed about pet waste 600 with a bag 500 installed in the device 50, the pet waste 600 will be enclosed within the bag 500. A handle 102, which is spaced from the jaws 300*a* and 300*b* by a frame 100 (see, e.g., FIG. 2), may be grasped by a user to situate and orient the device 50 as desired, with a trigger 200 (see, e.g., FIG. 3) being used to actuate the jaws 300*a* and 300*b*.

Looking more particularly to the operation of the jaws 300*a* and 300*b*, these include pivot ends 318*a*, 318*b*, 318*c*, 318*d* (see, e.g., FIG. 10*b*) opposite their jaw ends 306*a* and 306*b*, and an intermediate section 304*a*, 304*b*, 304*c*, 304*d* between their pivot ends 318*a*, 318*b*, 318*c*, 318*d* and jaw ends 306*a* and 306*b*. When the jaws 300*a* and 300*b* move from their open jaw state (FIG. 17*a*) to their closed jaw state (FIG. 17*c*), they initially move their jaw ends 306*a* and 306*b* towards each other while remaining spaced from the frame 102, and only subsequently after a period of such movement do the jaw ends 306*a* and 306*b* travel towards the handle 102. This motion is achieved by defining tracks 138*a*, 138*b*, 138*c*, and 138*d* in the frame 100 (see, e.g., FIGS. 1 and 17*a*) wherein the intermediate sections 304*a*, 304*b*, 304*c*, and 304*d* travel, with the tracks 138*a*, 138*b*, 138*c*, and 138*d* constraining the jaw ends 306*a* and 306*b* to the foregoing motion. The jaws 300*a* and 300*b*, and more particularly their intermediate sections 304*a*, 304*b*, 304*c*, and 304*d*, are therefore both slidably and pivotally connected to the frame 100.

The jaws 300*a* and 300*b* are preferably situated within a pair of opposing shells 400*a* and 400*b* which are pivotally affixed to the frame 100 at axle 104, and which have openable and closable shell lips 416*a* and 416*b* opposite the pivot. The shells 400*a* and 400*b* are movable between a closed shell state (FIG. 17*c*) with their shell lips 416*a* and 416*b* proximate each other and with the jaws 300*a* and 300*b* resting surrounded within the shells 400*a* and 400*b* (and the jaws 300*a* and 300*b* being in the closed jaw state), and an open shell state (FIG. 17*a*) wherein the shell lips 416*a* and 416*b* are spaced from each other and the jaws 300*a* and 300*b* are exposed in the open jaw state with the jaw ends 306*a* and 306*b* protruding from the shell lips 416*a* and 416*b*. Links 402*a*, 402*b*, 402*c*, and 402*d* connect the shells 400*a* and 400*b* to the jaws 300*a* and 300*b* whereby actuation of the jaws 300*a* and 300*b* to open or close similarly actuates the shells 400*a* and 400*b*. When the shells 400*a* and 400*b* move toward the closed shell state, portions of the shells 400*a* and 400*b* pass closely proximate jaw ends 306*a* and 306*b*, whereby a bag 500 having its mouth engaged about the jaw ends 306*a* and 306*b* will have the bag mouth disengaged by the shells 400*a* and 400*b* from the jaw ends 306*a* and 306*b*. Upon subsequent opening of the jaws 300*a* and 300*b* and shells 400*a* and 400*b*, the waste-laden bag 500 is then readily dropped out of the device 50.

Further advantages, features, and objects of the invention will be apparent from the following detailed description of the invention in conjunction with the associated drawings.

BRIEF DESCRIPTION OF THE DRAWINGS

FIGS. 9*a* to 9*c* are side elevational partial sectional views taken along the line B—B of FIG. 17*c* illustrating the sequence of trigger locking and unlocking.

FIGS. 10*a* and 10*b* are perspective views of the waste collection device in the closed/locked state.

FIGS. 11*a* and 11*b* are perspective views of the waste collection device in the open/unlocked state.

DETAILED DESCRIPTION OF PREFERRED VERSIONS OF THE INVENTION

Figure 1:
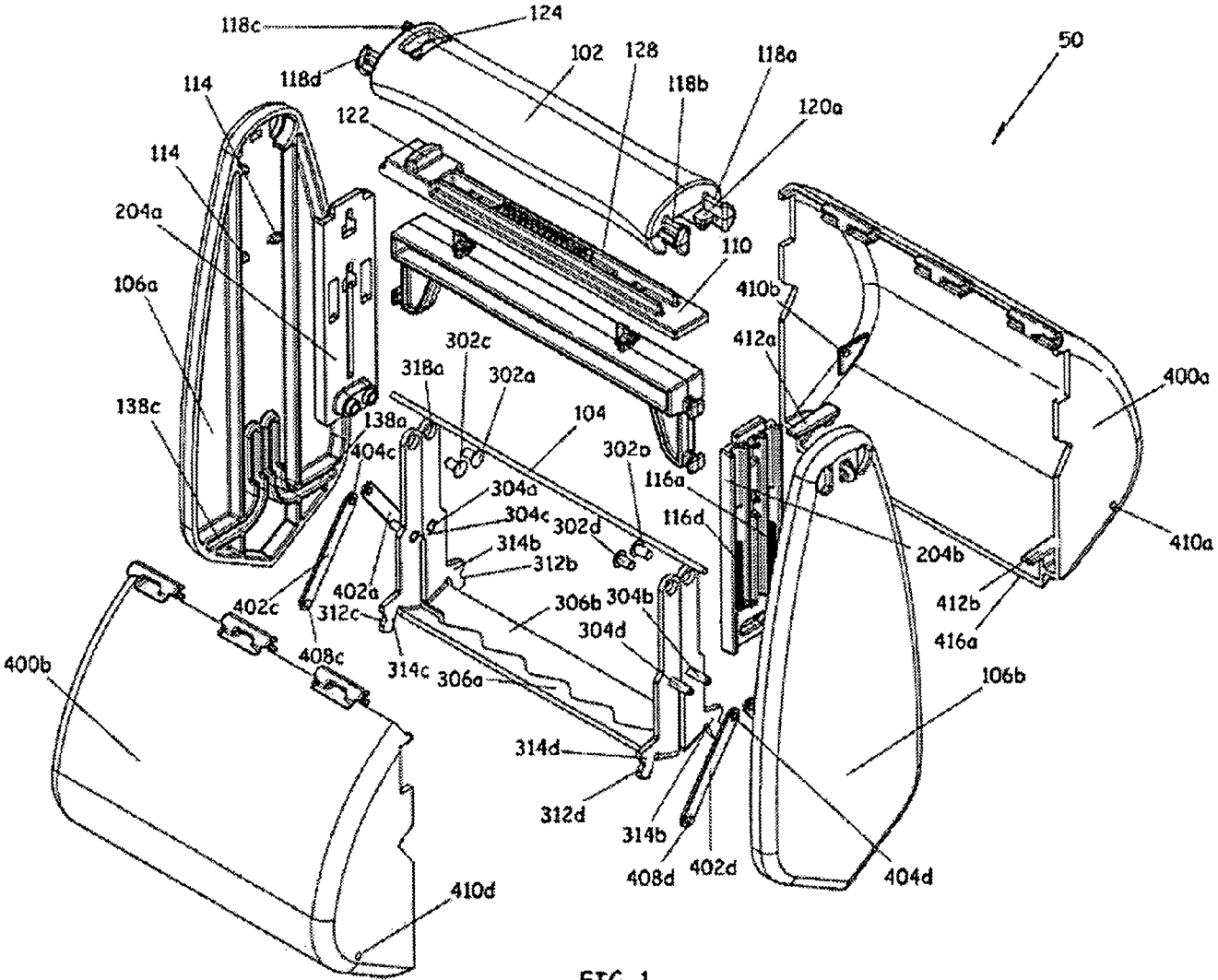
FIG. 1 is a perspective exploded view showing various parts of the waste collection device.
Figure 2:
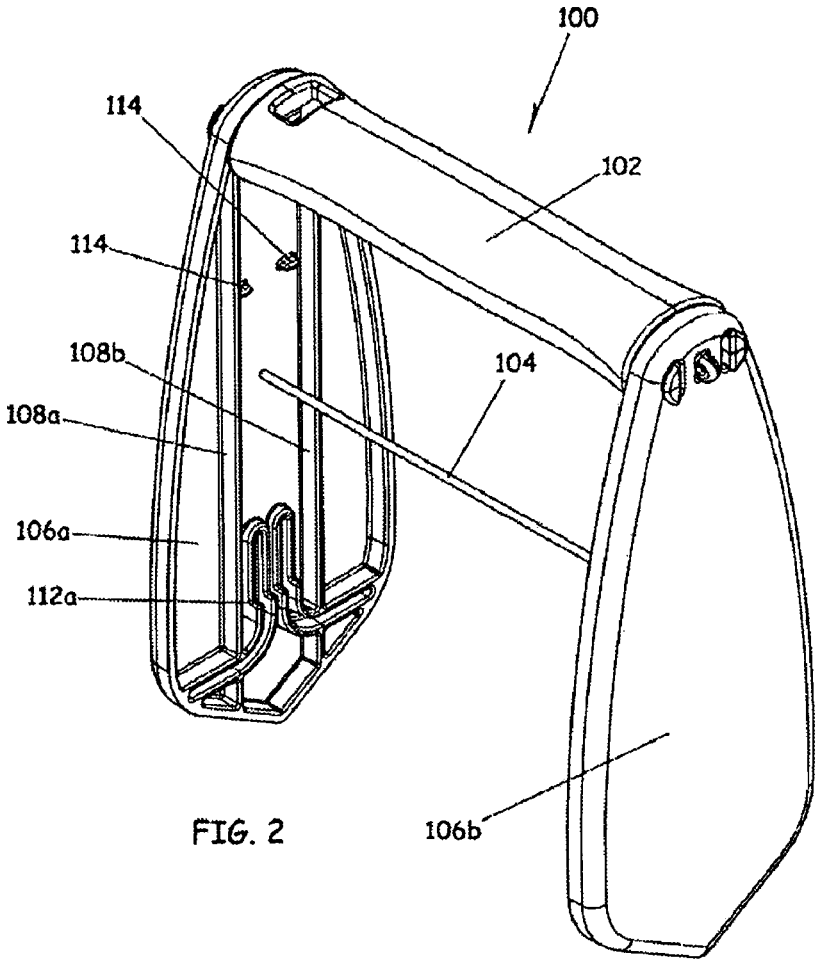
FIG. 2 is a perspective view showing the frame.

Frame and Trigger Structure and Function (primarily shown in FIGS. 1–9):

FIG. 1 illustrates a perspective exploded view of an exemplary waste collection device, generally designated as 50. FIG. 2 illustrates a perspective view of the frame of the waste collection device 50. The frame, generally designated as 100, includes the handle 102, axle 104, and side members 106*a* and 106*b*. A snap-fit is the preferred method for affixing the side members 106*a* and 106*b* to the handle 102. The side members 106*a* and 106*b* may also be attached to the handle 102 by means of fasteners or adhesives. A press fit is the preferred means of affixing the axle 104 to the side members 106*a* and 106*b*.

Figure 3:
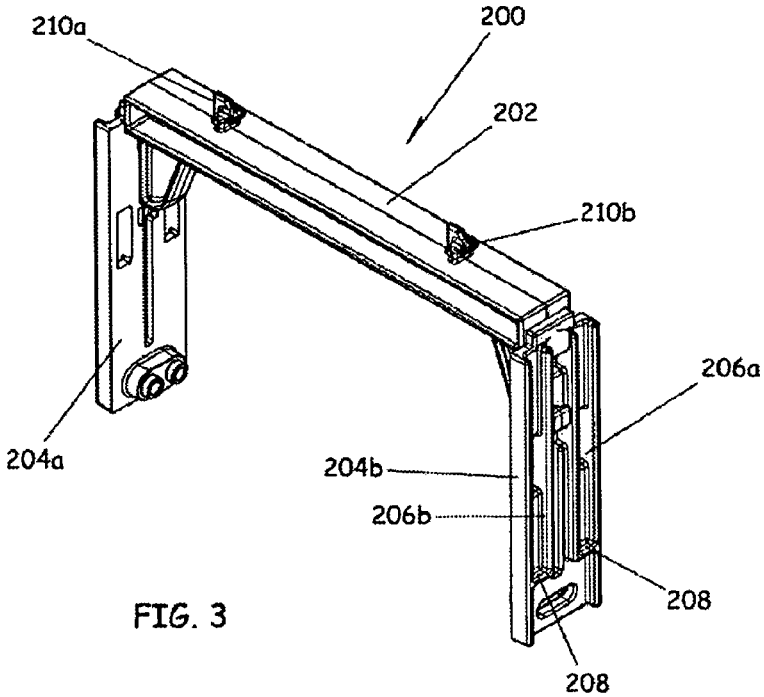
FIG. 3 is a perspective view showing the trigger.

FIG. 3 illustrates a perspective view of the trigger. The trigger, generally designated as 200, includes the trigger handle 202 and slides 204*a* and 204*b*. A snap-fit is the preferred method for affixing the slides 204*a* and 204*b* to the trigger handle 202. The slides 204*a* and 204*b* may also be attached to the trigger handle 202 by means of fasteners or adhesives.

Figure 4:
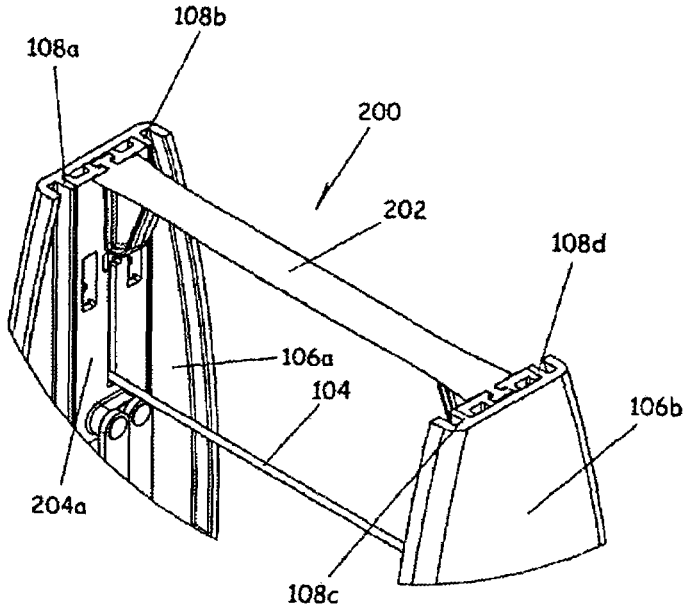
FIG. 4 is a perspective partial sectional view taken along the line A—A of FIG. 17*c* showing the slide alignment walls.
Figure 5:
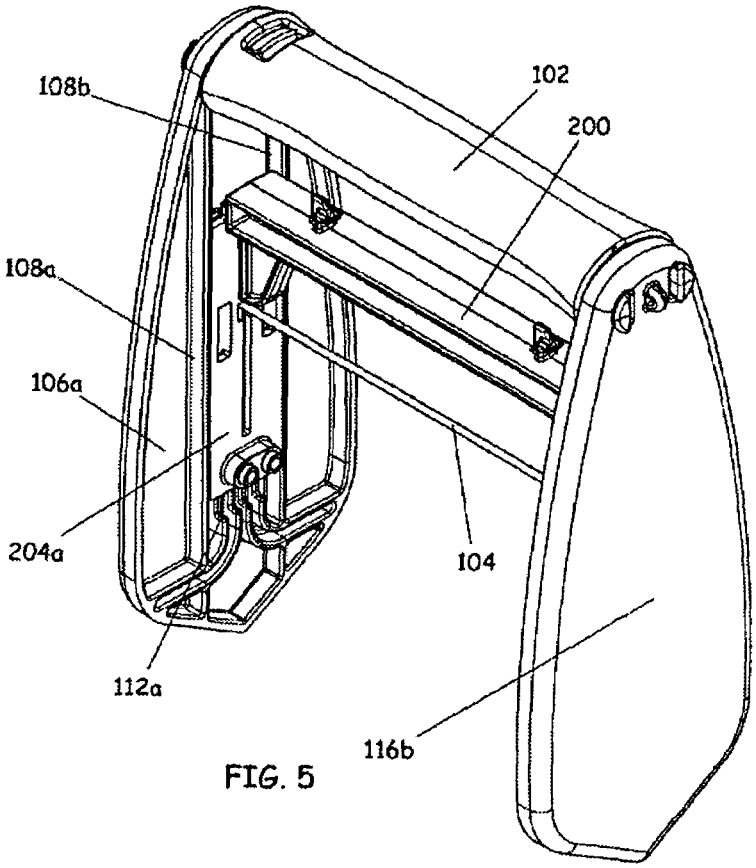
FIG. 5 is a perspective view showing the trigger aligned within the frame.
Figure 6:
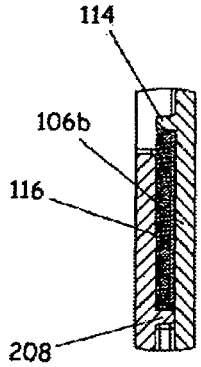
FIG. 6 is a side elevational partial sectional view taken along the line C—C of FIG. 17*c* showing the slide spring locating features.

As shown in FIGS. 4 and 5, the trigger 200 maintains its alignment with the frame 100 by means of slide alignment walls 108*a* and 108*b* on side member 106*a*, and slide alignment walls 108*c* and 108*d* on side member 106*b*. The trigger 200 can be moved in an upward direction until the trigger meets the lock plate 110 (see FIG. 9*a*). As shown in FIG. 5, the trigger 200 can move in a downward direction until slides 204*a* and 204*b* meet the lower slide stop surface 112*a* on side member 106*a*, and the lower slide stop surface 112*b* on side member 106*b*. Referring to FIG. 6, the slide springs 116*a* and 116*d* are positioned by slide spring slots 206*a* and 206*b* on slide 204*b*, upper spring stop 114, and lower spring stop 208 (see also FIGS. 1 and 3) so as to continually urge the trigger 200 toward the lower slide stops 112*a*, and 112*b*. Slide springs 116*b* and 116*c* are similarly positioned within slide 204*a*.

Trigger Lock Mechanism Structure and Function (primarily shown in FIGS. 7–11)

Figure 7:
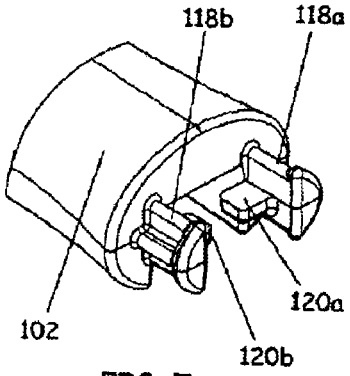
FIG. 7 is a perspective detail view of the handle showing vertical guide walls and horizontal guide walls.
Figure 8:
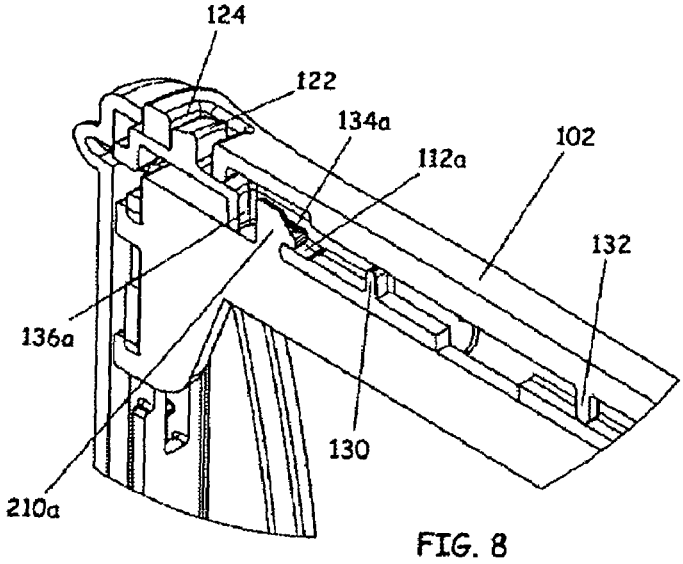
FIG. 8 is a perspective partial sectional view taken along the line B—B of FIG. 17*c* showing details of the trigger lock mechanism.
Figure 9A:
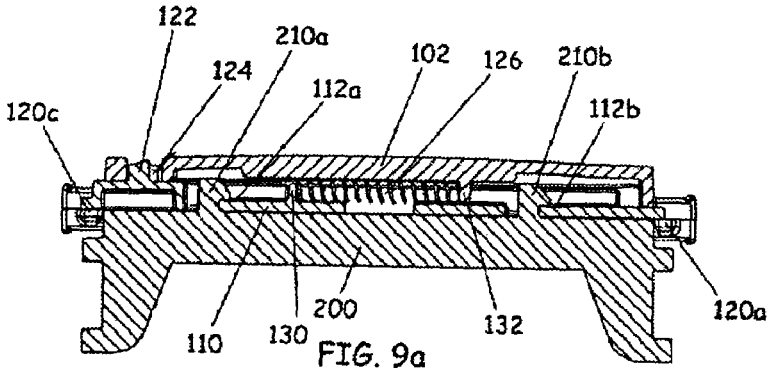
Figure 9C:
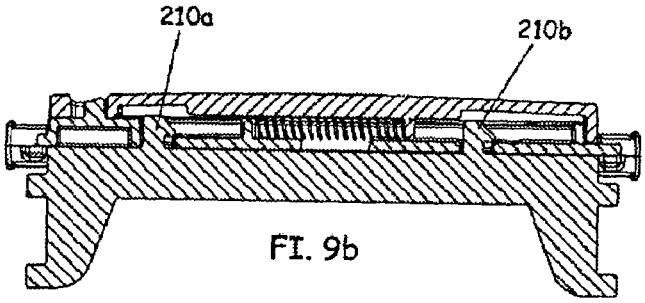
Figure 9C:
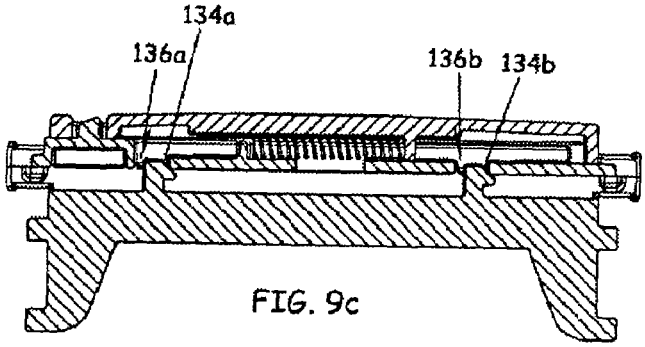

Referring now to FIG. 7, a perspective detail view of the handle of the waste collection device 50 with vertical guide walls 118 and horizontal guide walls 120 is shown. The lock plate 110 (see FIG. 1) is aligned within the handle 102 by means of vertical guide walls 118*a* and 118*b* and horizontal guide walls 120*a* and 120*b*. Vertical guide walls 118*c* and 118*d* and horizontal guide walls 120*c* and 120*d* are similarly located at the opposite end of the handle 102 (see FIG. 1). Lock plate 110 motion is limited by lock button 122, which is constrained to move within lock button slot 124 (see FIGS. 1, 8, and 9*a*). As shown in FIG. 9*a*, the lock plate spring 126 is positioned so as to continually urge the lock button 122 against the outside of lock button slot 124. The lock plate spring 126 is aligned within the lock plate 110 by means of lock spring slot 128 (see FIGS. 8 and 10*b*), lock plate spring stop 130, and handle spring stop 132. FIGS. 8 and 9*a* shows the trigger 200 and lock plate 110 in the closed/locked state. In the closed/locked state, locking surfaces 112*a* and 112*b* are positioned under the trigger lock tabs 210*a* and 210*b* and thus prevent downward motion of the trigger 200. When the user applies force to the lock button 122 so as to compress the lock spring 126 and urge the lock plate 110 toward the center of the handle 102, locking surfaces 112*a* and 112*b* are thus removed from under the trigger lock tabs 210*a* and 210*b* (see FIG. 9*b*). When the lock plate 110 is positioned as shown in FIG. 9*b* the slide springs 116*a*, 116*b*, 116*c*, and 116*d* urge the trigger downward to the position shown in FIGS. 11*a* and 11*b*. The trigger 200 is returned to the closed/locked state by upward urging from the user's fingers. As the trigger 200 is urged upwards, the trigger lock tab ramp surfaces 134*a* and 134*b* contact the lock plate as shown in FIG. 9*c*. As upward urging continues the trigger lock tab ramp surfaces 134*a* and 134*b* cause the lock plate 110 to move so that the trigger lock tabs 210*a* and 210*b* can pass through the trigger lock tab slots 136*a* and 136*b*. As upward urging continues, trigger lock tabs 210*a* and 210*b* will be in such a position so that the lock plate spring 126 can urge the locking surfaces 112*a* and 112*b* under the trigger lock tabs 210*a* and 210*b*. The trigger 200 is thus returned to the locked position.

Jaw and Shell Structure and Function (primarily FIGS. 1, 10, and 12)

FIGS. 10*a* and 10*b* illustrate the waste collection device 50 in the closed state. Jaws 300*a* and 300*b* have jaw ends 306*a* and 306*b*, pivot ends 318*a*, 318*b*, 318*c*, and 318*d* opposite the jaw ends 306*a* and 306*b*, and pin-bearing intermediate sections 304*a*, 304*b*, 304*c*, and 304*d* between the jaw ends 306*a* and 306*b* and pivot ends 318*a*, 318*b*, 318*c*, and 318*d*. The pivot ends 318*a*, 318*b*, 318*c*, and 318*d* of jaws 300*a* and 300*b* are pivotally affixed to slides 204*a* and 204*b* by means of jaw pivot pins 302*a*, 302*b*, 302*c*, and 302*d* (see FIGS. 1 and 10*b*). Intermediate section track pins 304*a* and 304*b* are affixed to the jaw 300*a*, whereas intermediate section track pins 304*c* and 304*d* are affixed to the jaw 300*b* (see FIGS. 1 and 10*b*). Jaw ends 306*a* and 306*b* include an undulating surface having ridges 308 and valleys 310 which intermeshes between the two jaws so as to move through grass more effectively and hold the waste-laden bag securely (see FIGS. 10*b* and 17*c*). Jaws 300*a* and 300*b* also include bag attachment notches 312*a*, 312*b*, 312*c*, and 312*d* (see FIGS. 1 and 17*a*). Referring to FIG. 14*b*, a bottom elevational view of a jaw 300 and the bag attachment tabs 314 is shown. The bag attachment tabs 314 are offset from the jaw end 306 and thus create a region 316. Region 316 will be discussed at greater length below.

Tracks 138*a*, 138*c* are located on side member 106*a* as shown in FIG. 1. Tracks 138*b*, 138*d* are similarly located on side member 106*b*. The intermediate track pins 304*a*, 304*b*, 304*c*, and 304*d* are aligned within tracks 138*a*, 138*b*, 138*c*, and 138*d* respectively. The shell halves 400*a* and 400*b* are pivotally affixed to axle 104. In addition, the shell halves 400*a* and 400*b* are connected to the jaws 300*a* and 300*b* by means of links 402*a*, 402*b*, 402*c*, and 402*d*. One end of the links is pivotally mounted to the intermediate track pins 304*a*, 304*b*, 304*c*, and 304*d*, by means of track pin pivot holes 404*a*, 404*b*, 404*c*, and 404*d* (see FIGS. 1 and 10*b*). The other end of the links is pivotally affixed to shell/link pivot holes 410*a*, 410*b*, 410*c*, and 410*d* (see FIG. 10*b*) by means of link pivots 408*a*, 408*b*, 408*c*, and 408*d*.

Figure 14A:
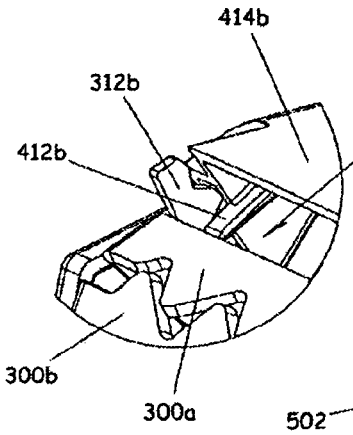
FIG. 14*a* is a perspective detail view illustrating stripper function.
Figure 14B:
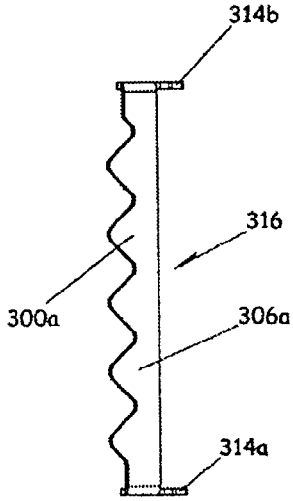
FIG. 14*b* is a bottom plan view of a jaw showing bag attachment notch orientation.
Figure 17A:
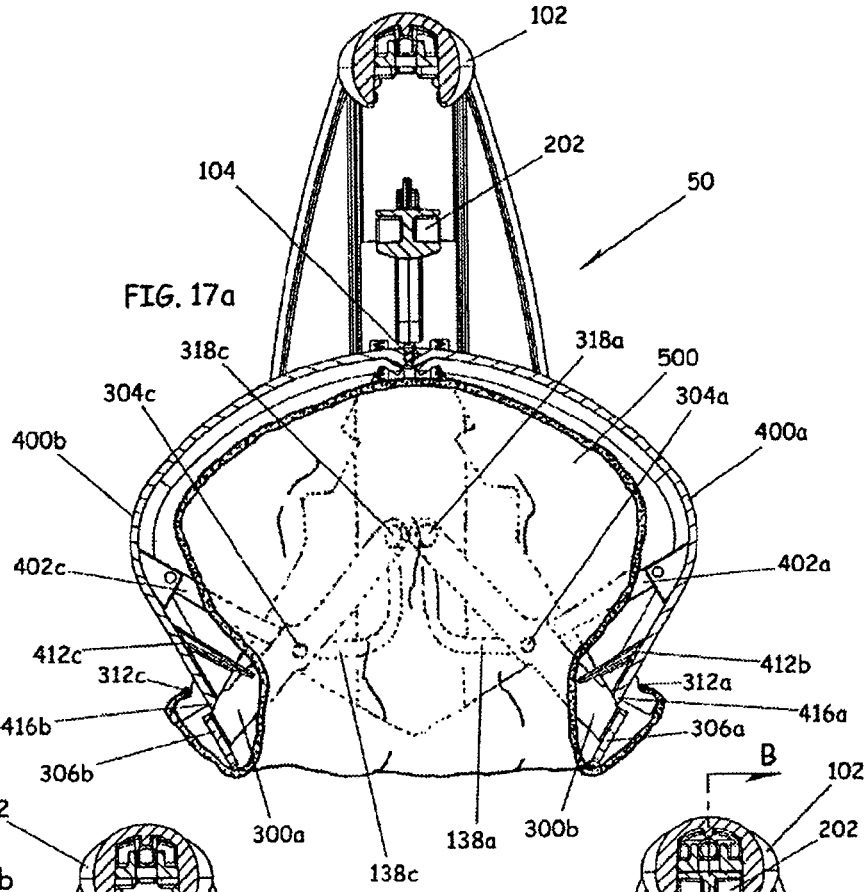
FIGS. 17*a* to 17*c* are side elevational sectional views illustrating the sequence of jaw and shell motion during waste collection.
Figure 17B:
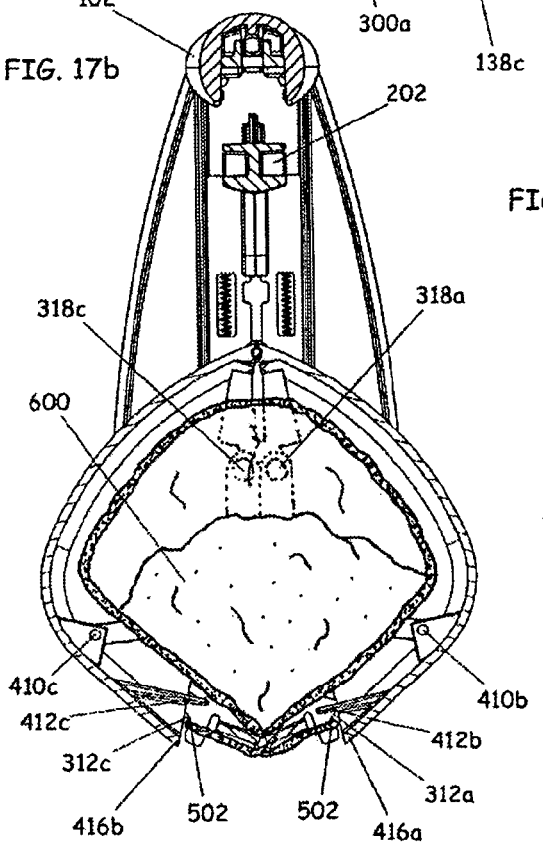
Figure 17C:
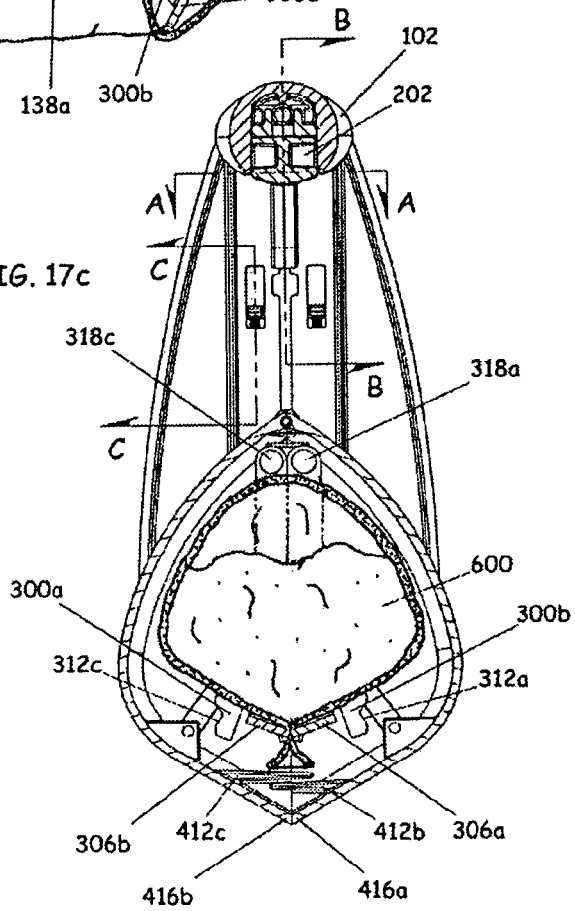

Integral to the shell halves are the bag strippers 412*a*, 412*b*, 412*c*, and 412*d* (see FIG. 1, 14*a* and 17*a*). As shown in FIG. 17*b*, the bag strippers 412*a*, 412*b*, 412*c*, and 412*d* extend beyond the lips 416*a* and 416*b* of the shell halves 400*a* and 400*b*. In addition, the bag strippers 412*a*, 412*b*, 412*c*, and 412*d* are positioned so that they overlap with one another as shown in FIG. 17*c*. The overlap allows the shell halves 400*a* and 400*b* to close completely even though the bag strippers 412*a*, 412*b*, 412*c*, and 412*d* extend beyond the lips 416 and 416*b* of the shell halves 400*a* and 400*b*.

FIG. 17*c* illustrates a side elevational sectional view of the waste collection device 50 in the closed/locked state. When force is applied to the lock button 122 so as to move the lock plate to the unlocked position (see FIG. 9*b*) the trigger 200 is urged downward by the slide springs 116*a*, 116*b*, 116*c*, and 116*d*. As the trigger 200 begins to move away from the handle 102, the track pins 304*a*, 304*b*, 304*c*, and 304*d* also move away from the handle 102, in the same direction (i.e., first direction) as the trigger 200, within the tracks 138*a*, 138*b*, 138*c*, and 138*d*. As this motion occurs, the jaws 300*a* and 300*b* actuate the links 402*a*, 402*b*, 402*c*, and 402*d* to situate the shell halves 400*a* and 400*b* such that the jaw ends 306*a* and 306*b* begin to protrude out of the cavity formed by shell halves 400*a* and 400*b* (see FIG. 17*b*). As the trigger 200 continues to move away from the handle 102, the track pins 304*a*, 304*b*, 304*c*, and 304*d* begin to move in a direction (i.e., second direction) perpendicular to the direction of trigger motion, within the tracks 138*a*, 138*b*, 138*c*, and 138*d* and the jaws 300*a* and 300*b* begin to move away from each another. Motion of the trigger 200 continues until the slides 204*a* and 204*b* abut the lower slide stop surfaces 112*a* and 112*b*, and the jaws 300*a* and 300*b*, now spaced from each other, have actuated the links 402*a*, 402*b*, 402*c*, and 402*d* to situate the shell halves 400*a* and 400*b* in the position shown in FIG. 17*a*. This is described as the open/unlocked state. FIGS. 11*a* and 11*b* also illustrate a perspective view of the waste collection device 50 in the open/unlocked state.

When the trigger 200 is urged upward by the user's fingers, this motion is reversed. As the trigger 200 begins to move toward the handle 102, the track pins 304*a*, 304*b*, 304*c*, and 304*d* begin to move in a direction perpendicular to that of trigger motion (i.e., second direction), within the tracks 138*a*, 138*b*, 138*c*, and 138*d* and the jaws 300*a* and 300*b* begin to move toward each another. As this motion occurs, the jaws 300*a* and 300*b* actuate the links 402*a*, 402*b*, 402*c*, and 402*d* to situate the shell halves 400*a* and 400*b* such that the jaw ends 306*a* and 306*b*, now proximate each other, begin to retract into the cavity formed by shell halves 400*a* and 400*b* (see FIG. 17*b*). As the trigger 200 continues to move toward the handle 102, the track pins 304*a*, 304*b*, 304*c*, and 304*d* begin to move toward the handle 102, in the same direction (i.e., first direction) as the trigger 200, within the tracks 138*a*, 138*b*, 138*c*, and 138*d*. Motion of the trigger 200 continues until the trigger 200 is returned to the locked position (see FIG. 9*a*) and the jaws 300*a* and 300*b* have actuated the links 402*a*, 402*b*, 402*c*, and 402*d* to situate the shell halves 400*a* and 400*b* such that the shell halves 400*a* and 400*b* surround the retracting jaw ends 306*a* and 306*b* (see FIG. 17*c*). This is described as the closed/locked state. FIGS. 10*a* and 10*b* also illustrate a perspective view of the waste collection device 50 in the closed/locked state.

It should be noted that the motion of the jaw ends 306*a* and 306*b* corresponds to to the path defined by tracks 138*a*, 138*b*, 138*c*, and 138*d*. This allows the jaw ends 306*a* and 306*b* to slide under the waste material 600 as they move directly toward one another (i.e., in the second direction) and as they move upward (i.e., in the first direction) into the shell.

The preferred material for the handle 102, lock plate 110, slides 204*a* and 204*b*, side members 106*a* and 106*b*, trigger handle 202, shell halves 400*a* and 400*b*, and links 402*a*, 402*b*, 402*c*, and 402*d* is plastic. The preferred material for the lock spring 126, slide springs 116*a*, 116*b*, 116*c*, and 116*d*, axle 104, jaws 300*a* and 300*b*, and jaw pins 302*a*, 302*b*, 302*c*, and 302*d* is stainless steel or aluminum. This combination of materials ensures that adequate strength is provided, and that little or no corrosion will occur.

Figure 12A:
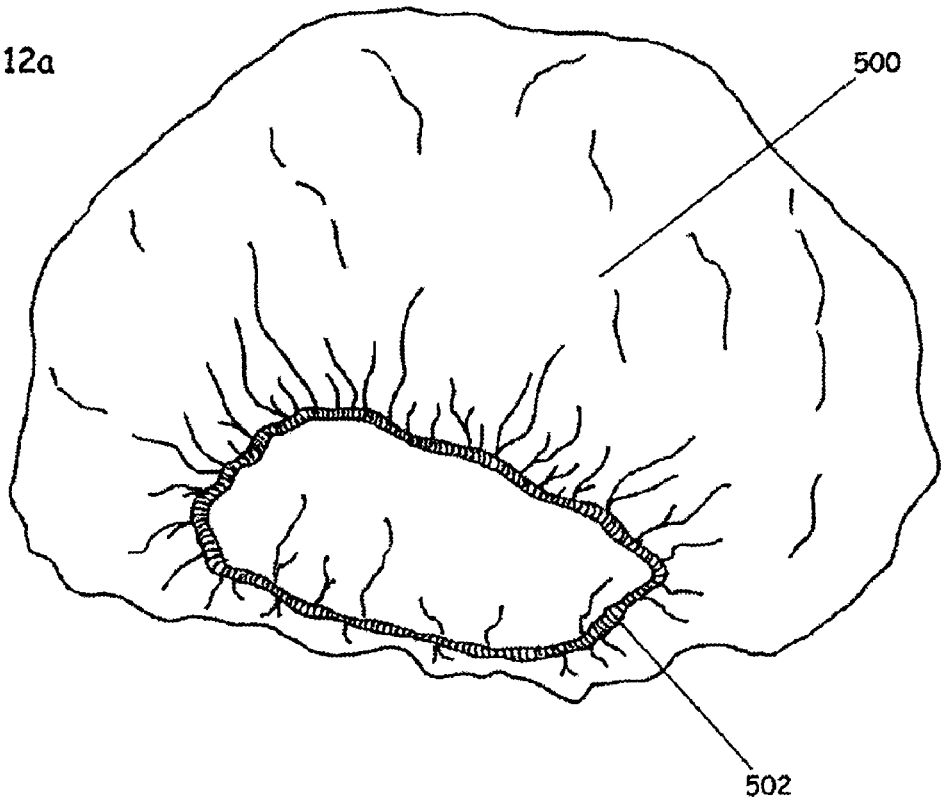
FIG. 12*a* is a perspective view of the liner bag.
Figure 12B:
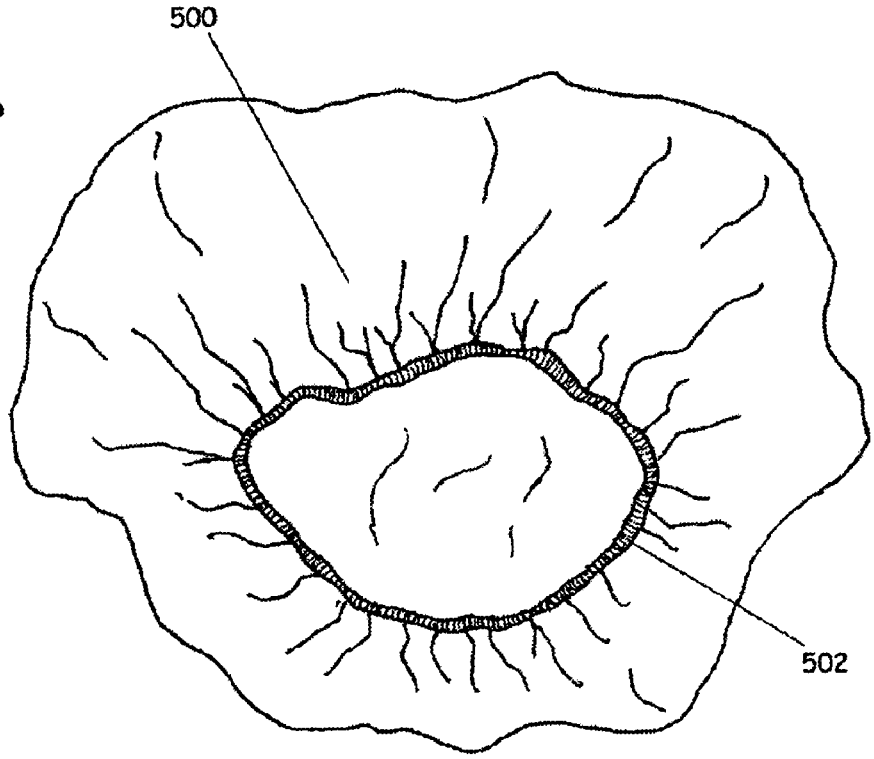
FIG. 12*b* is a bottom plan view of the liner bag.

Liner Bag Structure and Function (primarily FIGS. 12*a* and 12*b*)

While the waste collection device 50 could be used in conjunction with ordinary plastic (or other) liner bags (or could even conceivably be used with no liner bag at all, though this would be more unsanitary), the liner bag 500 most preferred for use with the device 50 is formed of a thin plastic film with an elastic material attached to its edge (see FIGS. 12*a* and 12*b*), as in common shower caps (and more recently, in food storage bags/covers sold for use atop food containers). The elastic material forms an elastic edge 502 on the liner bag 500 and allows the liner bag 500 to be easily attached to the device and allows it to self-seal. The elastic edge 502 thus functions as an integral attachment and sealing feature and simplifies bag installation and sealing.

Operation: Liner Bag Installation (primarily FIGS. 13 to 17)

Figure 13A:
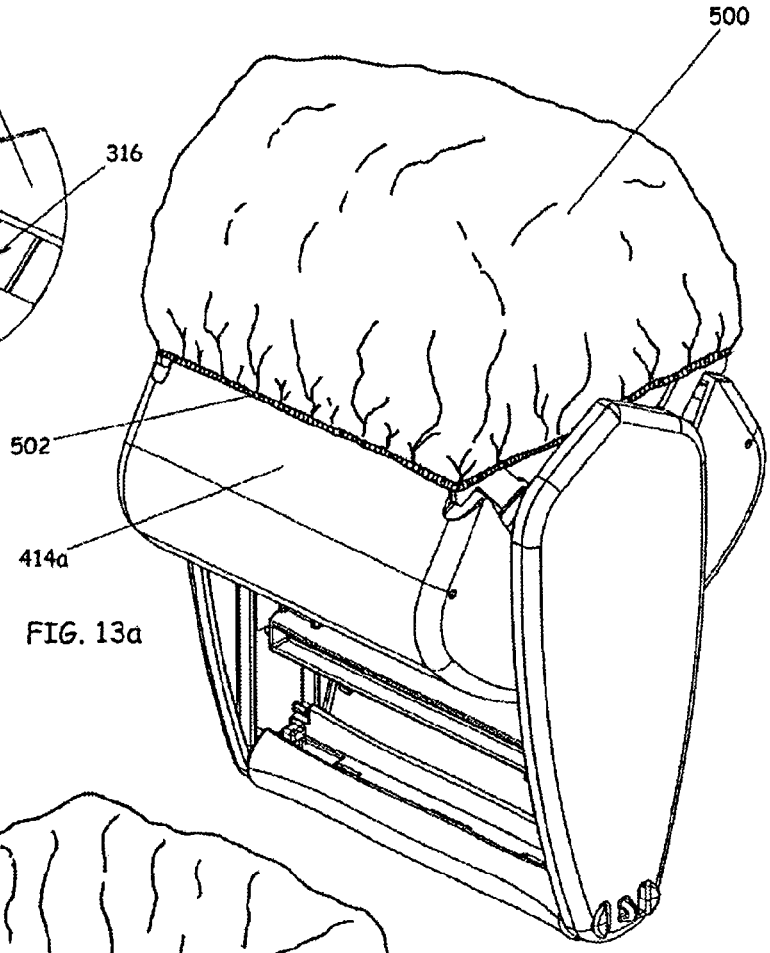
FIGS. 13*a* and 13*b* are perspective views illustrating the sequence of liner bag installation.
Figure 13B:
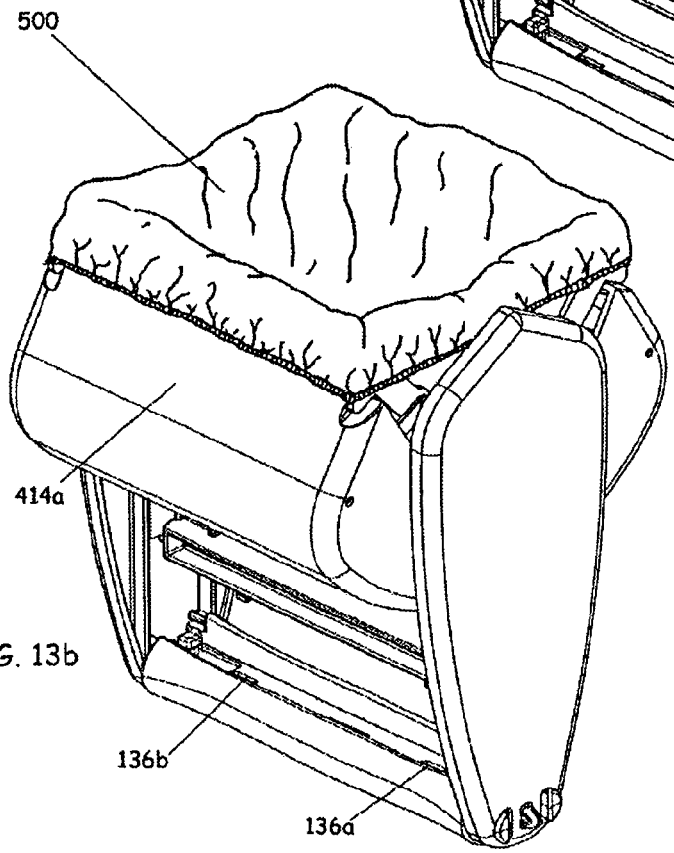
Figure 15:
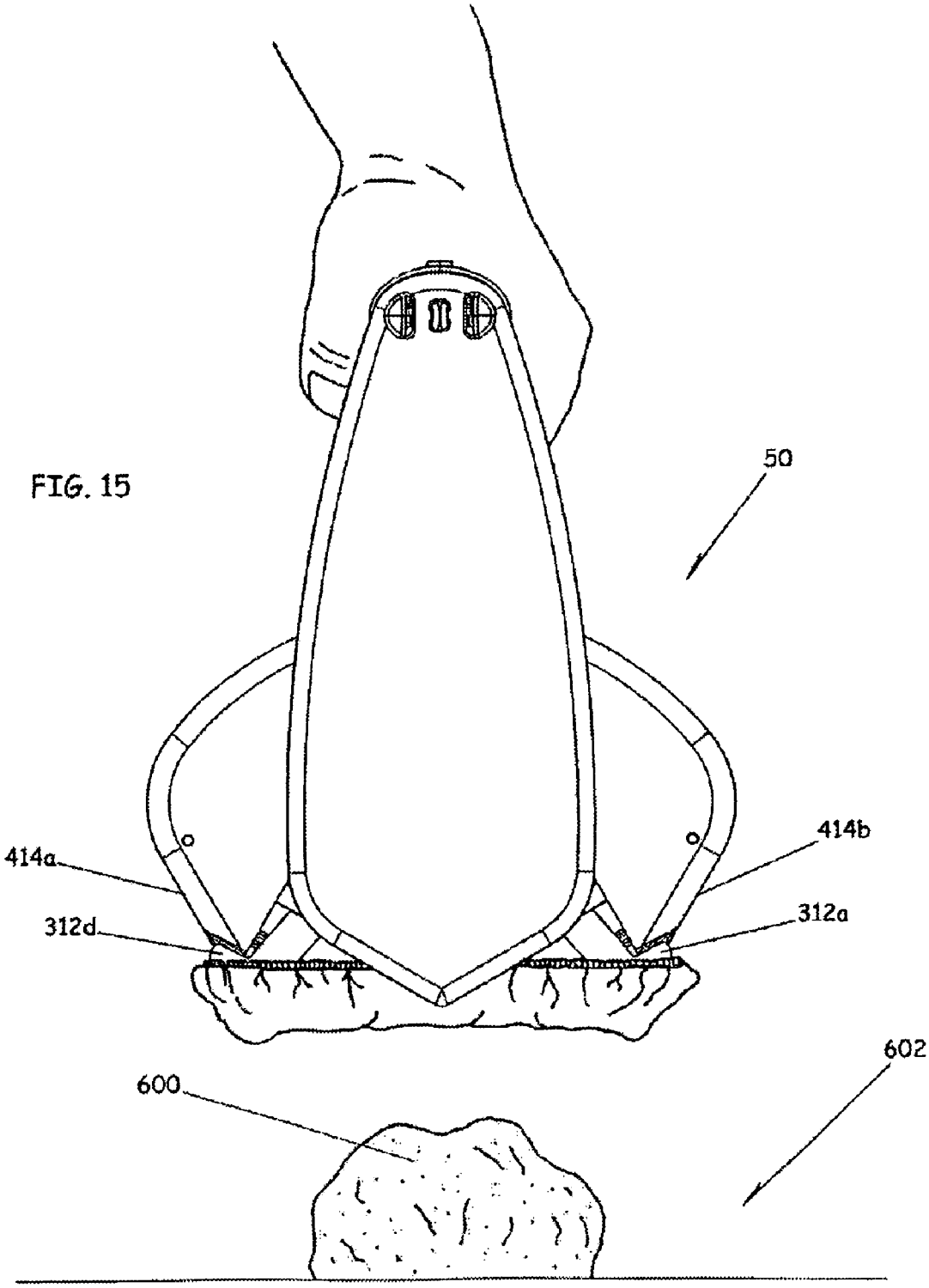
FIG. 15 is a side elevational view showing the waste collection device being used in the typical manner.

Prior to operation of the waste collection device 50, a liner bag 500 (see FIGS. 12*a* and 12*b*) is installed as shown in FIG. 13*b*. When the device is in the open state, the user places the elastic edge 502 of the liner bag 500 into the bag attachment notches 312*a*, 312*b*, 312*c*, and 312*d*. The bag is thus positioned as shown in FIG. 13*a*. FIGS. 15 and 17*a* show that in the open state of the waste collection device 50, the bag attachment notches 312*a*, 312*b*, 312*c*, and 312*d* on the jaws 300*a* and 300*b* are aligned with the lower outer surfaces 414*a* and 414*b* (see FIGS. 13*a* and 14*a*) of the shell halves 400*a* and 400*b*. The lower outer surfaces 414*a* and 414*b* help guide the elastic edge 502 into the bag attachment notches 312*a*, 312*b*, 312*c*, and 312*d*. The user then takes his/her hand and pushes the liner bag 500 into the cavity formed by the shell halves 400*a* and 400*b* into the position shown in FIG. 13*b*. Once the liner bag 500 is installed, the device is ready for use. It is notable that when the preferred liner bag 500 is used, the liner bag attachment and sealing method requires no secondary or inefficient mechanisms (e.g., clips or adhesives) either on the bag or the device.

It should be noted that a liner bag 500 cannot be loaded in anticipation of use of the device (e.g., the user cannot load a liner bag 500 before going on a walk with their dog) unless the waste collection device 50 remains in the open/unlocked state. Any time the waste collection device 50 is closed the bag will be stripped off of the bag attachment notches 312*a*, 312*b*, 312*c*, and 312*d* and made ready for disposal.

Figure 16:
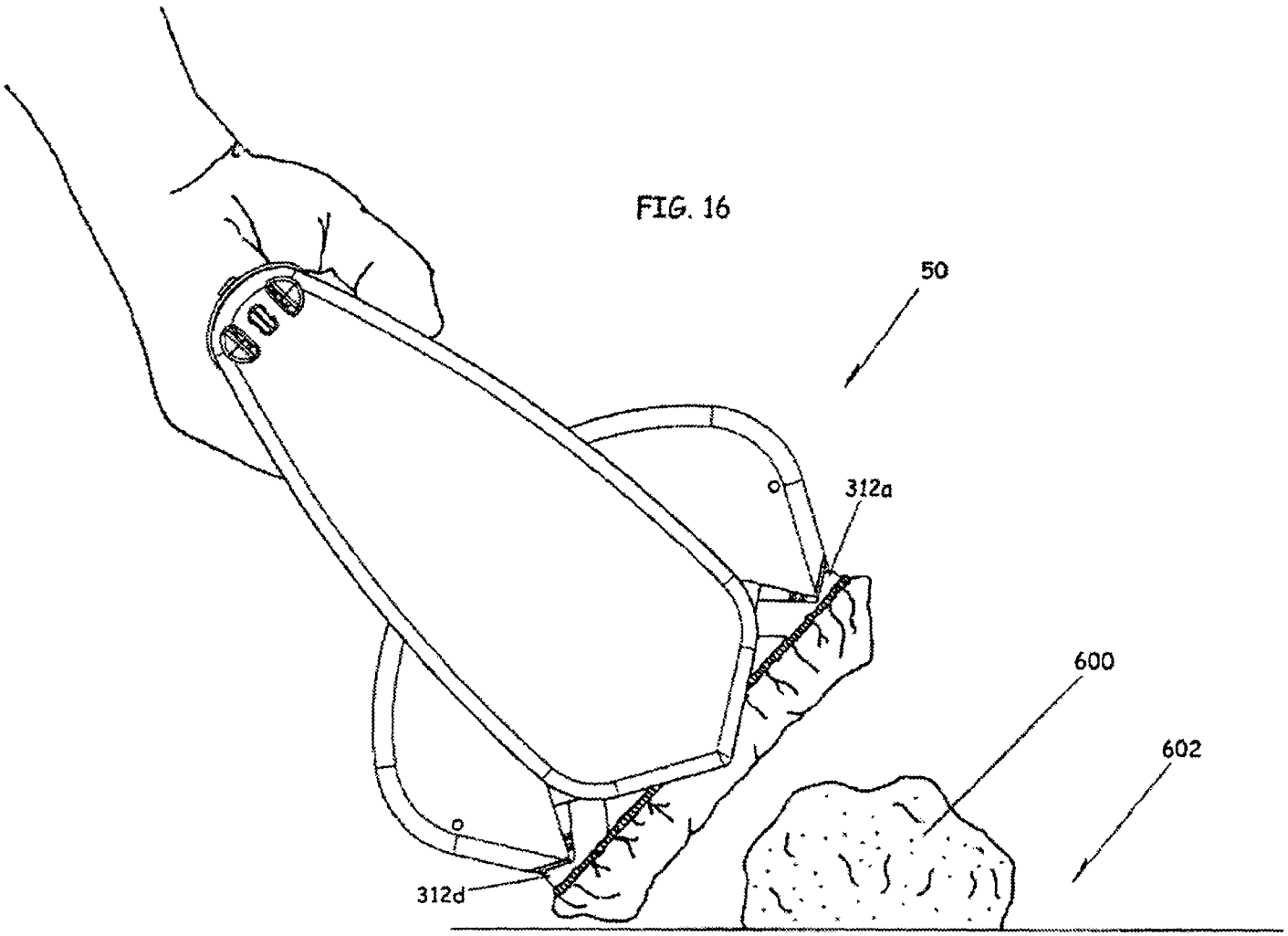
FIG. 16 is a side elevational view showing the waste collection device being used in a scoop-like manner.

General Operation (primarily shown in FIGS. 15 to 17)

FIG. 15 illustrates a side elevational view of the waste collection device 50 in typical operation. As shown in FIG. 15, the waste collection device 50 is first placed directly over the waste material 600. The device is then lowered over the waste material 600, preferably until the jaw ends 306*a* and 306*b* contact the ground 602. The user then begins to urge the trigger handle 202 upwardly with his/her fingers while keeping the jaw ends 306*a* and 306*b* in contact with the ground 602. In so doing, the jaw ends 306*a* and 306*b*, which are covered by the liner bag 500, slide underneath the waste material 600 until they are proximate each other as shown in FIG. 17*b*. At this point, the waste material is captured inside of the liner bag 500 and the liner bag 500 is held closed by the intermeshed jaw ends 306*a* and 306*b*. As previously described, the bag attachment tabs 314 are offset from the jaw end 306 and thus create a region 316. The bag attachment tabs 314*a*, 314*b*, 314*c*, and 314*d* therefore hold the elastic edge 502 of the liner bag 500 away from the jaw ends 306*a* and 306*b* across region 316.

As upward urging of the trigger handle 202 continues and the jaws 300*a* and 300*b* move toward the handle, the bag strippers 412*a*, 412*b*, 412*c*, and 412*d* (see FIG. 14*a*) pass through region 316, closely proximate the bag attachment notches 312*a*, 312*b*, 312*c*, and 312*d*. In so doing, they unhook the elastic edge 502 from the bag attachment notches 312*a*, 312*b*, 312*c*, and 312*d* (see FIG. 17*b*). The elastic edge 502, which was previously stretched around the bag attachment notches 312*a*, 312*b*, 312*c*, and 312*d*, contracts and closes the liner bag 500 (see FIG. 17*c*). Upward urging continues until the closed/locked state is reached (see FIG. 17*c*). In this position the waste-laden liner bag 500 continues to be securely held by the intermeshed jaw ends 306*a* and 306*b*. To dispose of the waste-laden liner bag 500, the user may hold the waste collection device 50 over a waste receptacle and unlock the trigger handle 202. The device then opens to the open/unlocked state shown in FIGS. 15 and 17*a*. Because the bag strippers 412*a*, 412*b*, 412*c*, and 412*d* have removed the elastic edge 502 of the liner bag 500 from the bag attachment notches 312*a*, 312*b*, 312*c*, and 312*d*, the liner bag 500 and its contents will fall out into the waste receptacle.

It is notable that the waste collection device 50 can also be used in a scoop-like manner as shown in FIG. 16. This is useful in the event that the waste material 600 is not deposited in a single location. In this case the device is used in a scoop-like manner to bring all of the waste material 600 to a single location. Once the waste material 600 is in a single location, the device 50 may be used in the manner as previously described.

Figure 18:
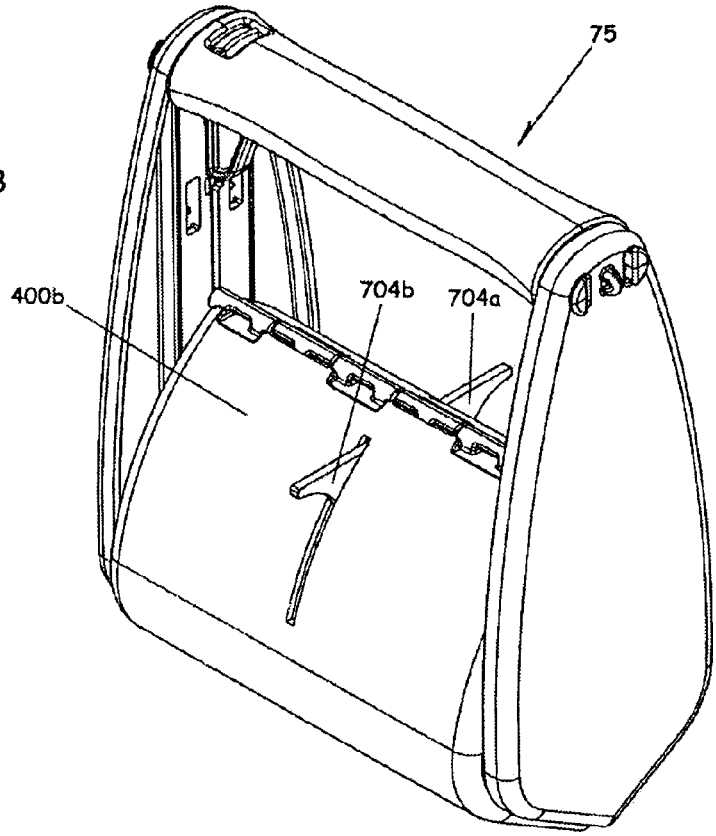
FIG. 18 is a perspective view showing a contemplated modification to the waste collection device, that being the manual bag stripper mechanism.

FIG. 18 illustrates a perspective view of a second exemplary waste collection device, generally designated as 75. This waste collection device 75 illustrates a possible variation of the waste collection device 50 that incorporates multi-use and liner preloading capability. The waste collection device 50 can only accomplish one waste pick-up cycle before disposal must occur. Because the liner bag 500 is automatically stripped off of the bag attachment notches 312*a*, 312*b*, 312*c*, and 312*d* upon closure, it cannot be opened again until the user is ready to dispose of the contents. This can pose a problem for a user whose dog (or other pet) requires more frequent waste cleaning activities, or for a user who has more than one dog. In order to accomplish multi-use functionality, the waste collection device 75 incorporates a secondary mechanism (i.e., a manual bag stripper 700). The manual bag stripper 700 allows the user to determine when the liner bag 500 is to be readied for disposal. Because the liner bag 500 is no longer automatically stripped upon closure, the user can open and close the waste collection device 75 more than once and the liner bag 500 will remain in place. This "multi-shot" functionality also allows the liner bag 500 to be pre-loaded on the waste collection device 75. Because the waste collection device 75 can be opened and closed with the liner bag 500 remaining in place, a liner bag 500 can be loaded in anticipation of use and the device can be closed. When the waste collection device 75 needs to be used, the user can open it and have a liner bag 500 already installed.

Figure 19:
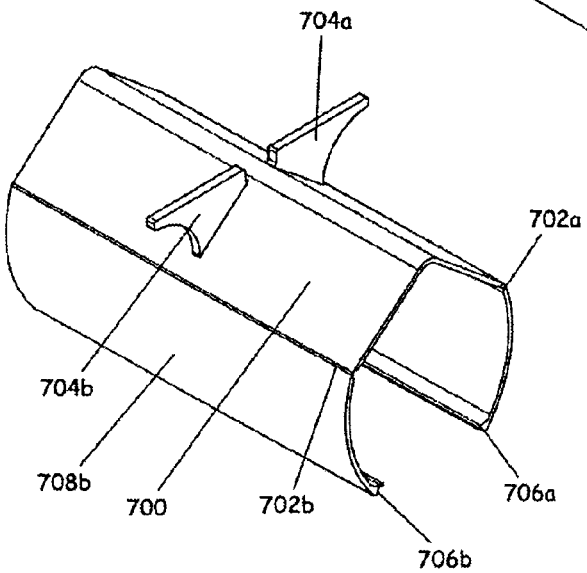
FIG. 19 is a perspective view of the manual bag stripper.
Figure 20:
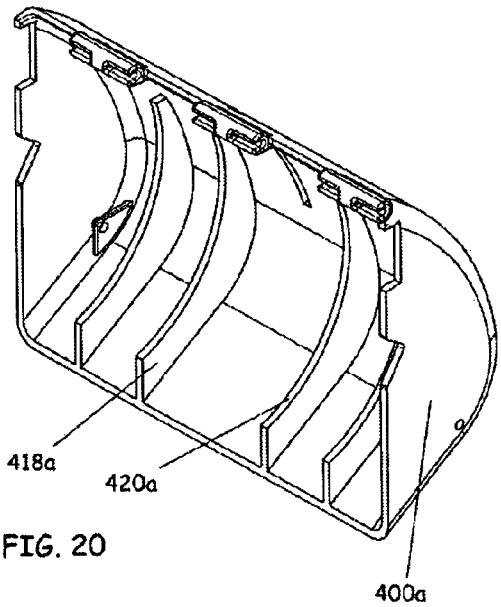
FIG. 20 is a perspective view of the modified shell half.
Figure 21A:
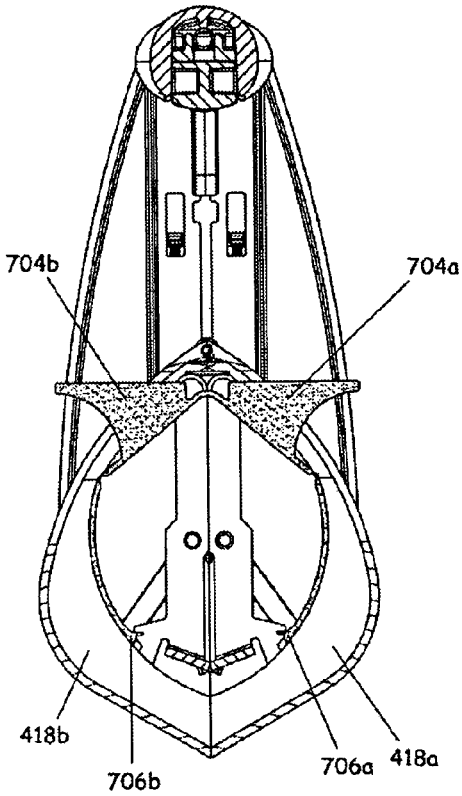
FIGS. 21*a* and 21*b* are side elevational sectional views illustrating the sequence of manual bag stripping.
Figure 23:
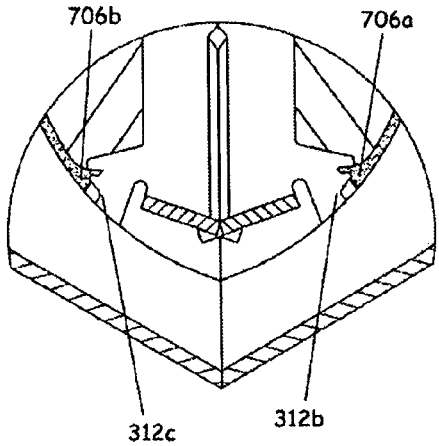
FIG. 23 is a side elevational detail view showing the manual bag stripper bag removal notches.
Figure 22:
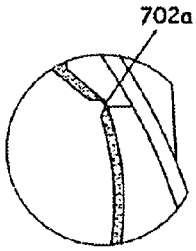
FIG. 22 is a side elevational detail view showing the manual bag stripper living hinge.
Figure 21B:
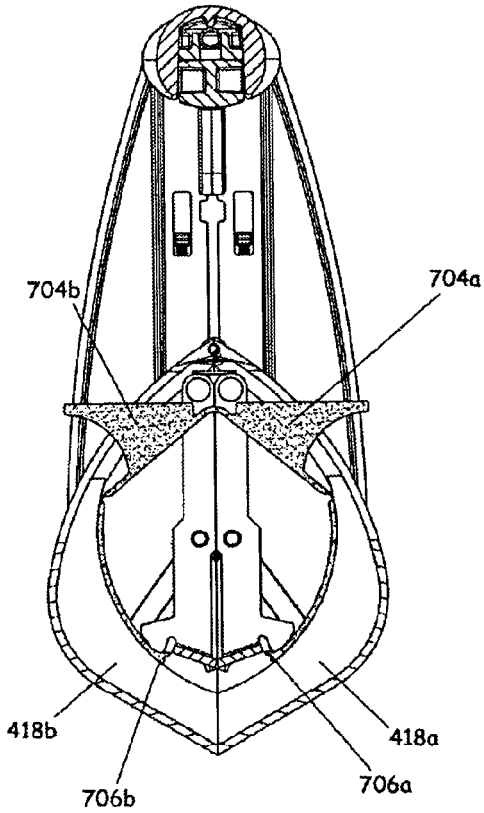

FIGS. 18 through 23 illustrate the waste collection device 75. FIG. 18 shows the waste collection device 75 in the closed/locked state with the manual bag stripper 700. Referring now to FIG. 19, the manual bag stripper 700 consists of actuation levers 704*a* and 704*b*, bag removal notches 706*a* and 706*b*, surfaces 708*a* and 708*b*, and hinges 702*a* and 702*b*. Referring now to FIG. 20, the shell halves 400*a* and 400*b* of the waste collection device 75 include, respectively, manual stripper alignment ribs 418*a* and 418*b* with alignment surfaces 420*a* and 420*b*. The manual bag stripper 700 is aligned within the shell halves 400*a* and 400*b* as shown in FIGS. 21*a* and 21*b*. FIG. 21*a* shows the manual bag stripper 700 in the closed/locked state. In this state, the bag removal notches 706*a* and 706*b* are positioned above the bag attachment notches 312*a*, 312*b*, 312*c*, and 312*d* (see FIG. 23). As the user pushes downward on either of the actuation levers 704*a* and 704*b*, the manual bag stripper 700 is guided by the alignment surfaces 420*a* and 420*b* and moves to the extended position shown in FIG. 21*b*. As the manual bag stripper 700 is guided downwards, flexing occurs by means of hinges 702*a* and 702*b* (see FIG. 22). This flexing ensures that the surfaces 708*a* and 708*b* remain in contact with the manual stripper alignment ribs 418*a* and 418*b*. In the extended position the bag removal notches 706*a* and 706*b* are thus positioned below the bag attachment notches 312*a*, 312*b*, 312*c*, and 312*d*. In moving from the retracted position to the extended position the bag removal notches 706*a* and 706*b* remove (i.e., strip) the elastic edge 502 from the bag attachment notches 312*a*, 312*b*, 312*c*, and 312*d*. Manual removal of the liner bag 500 is thus accomplished. Liner bag installation and operation of the waste collection device 75 is the same as that described for the waste collection device 50.

It should be understood that various preferred versions of the invention are shown and described above to illustrate different possible features of the invention and the varying ways in which these features may be combined. Apart from combining the different features of the foregoing versions in varying ways, other modifications are also considered to be within the scope of the invention. As an example, the device might be provided with a long handle in order to make it easier for people who have difficulty bending down to use the device. The versions of the device described above are intentionally small to make them convenient to carry. As another example, a mechanism to accommodate liner bag storage on the device might be provided. Alternatively or additionally, removal of the teeth from the jaws has been contemplated where the device will not often be used on grass—e.g., in city environments—since teeth may not be as effective on pavement or similar surfaces.

The invention is not intended to be limited to the preferred versions of the invention described above, but rather is intended to be limited only by the claims set out below. Thus, the invention encompasses all different versions that fall literally or equivalently within the scope of these claims.

What is claimed is:

1. A pet waste collection device comprising:

a. a pair of opposing jaws, the jaws having jaw ends, wherein the jaws are movable between a closed jaw state with their jaw ends proximate each other, and an open jaw state wherein the jaw ends are spaced from each other; and b. a handle spaced from the jaws; and c. a pair of opposing shells, the shells being pivotally movable between a closed shell state wherein the shells surround the jaws, and an open shell state wherein the shells expose the jaws, wherein the jaws, when moving from their closed jaw state to their open jaw state:

i. initially move away from the handle with their jaw ends remaining proximate each other, and ii. only subsequently after a period of such movement do the jaw ends move into spaced relationship.

2. The pet waste collection device of claim 1 wherein the jaws include:

a. pivot ends opposite their jaw ends, and b. an intermediate section between their pivot ends and jaw ends, and wherein a portion of the intermediate section travels:

i. initially along a linear path in a first direction, and
ii. subsequently along a path in a second direction different from the first direction, when the jaws move towards the open jaw state.

3. The pet waste collection device of claim 2 further comprising a frame maintaining the handle and jaws in spaced relation, and wherein the paths along which the portion of the intermediate section travels are defied in the frame.

4. The pet waste collection device of claim 3 wherein:
a. a track is defined in the frame, the track defining the paths along which the portion of the intermediate section travels, and
b. the intermediate section traveling in the paths defines a number riding in the track.

5. The pet waste collection device of claim 1 wherein portions of the shells pass closely proximate outer portions of the jaws when the shells move toward the closed shell state, whereby a bag having its bag mouth engaged about the outer portions of the jaws will have the bag mouth disengaged by the shells from the outer portions of the jaws when the shells move toward the closed shell state.

6. The pet waste collection device of claim 1 wherein the jaws protrude from the shells when the shells ale in the open shell state.

7. The pet wane collection device of claim 1 wherein comprising links connecting the shells to the jaws, and wherein:
a. situating the jaws in their closed jaw state actuates the links to situate the shells in their closed state, and
b. situating the jaws in their open jaw state actuates the links to situate the shells in their open state.

8. The pet waste collection device of claim 7 wherein the links urge the shells toward the handle when the jaws are moved toward their open jaw state, whereby the jaws protrude from the shells when the jaws reach their open jaw state.

9. The pet waste collection device of claim 1 further comprising a frame, the frame including a pair of side members extending from opposing sides of the handle, and wherein the jaws are slidably connected between the side members.

10. The pet waste collection device of claim 9 wherein the jaws are also pivotally connected between the side members.

11. The pet waste collection device of claim 9 wherein the pair of opposing shells is pivotally connected between the side members.

12. A pet waste collection device comprising:
a. a pair of opposing jaws, the jaws having jaw ends, wherein the jaws are movable between a closed jaw state with their jaw ends proximate each other, and an open jaw state wherein the jaw ends are spaced from each other;
b. a pair of opposing shells wherein the jaws are situated, the shells having shell lips, wherein the shells are movable between:
i. a closed shell state with their shell lips proximate each other and with the jaws resting within the shells in the closed jaw state, and
ii. an open shell state wherein the shell lips are spaced from each other and the jaws are in the open jaw state with the jaw ends protruding from the shell lips; and
c. a handle spaced from the shells and jaws, and wherein:
i. the shells are pivotally affixed with respect to the handle, and
ii. the jaws are slidably affixed with respect to the handle.

13. The pet waste collection device of claim 12 further comprising links extending between the jaws and the shells, wherein the links move the shells between their open and closed shell states when the jaws are moved between their open and closed jaw states.

14. The pet waste collection device of claim 12 wherein the jaws are also pivotally affixed with respect to the handle.

15. The pet waste collection device of claim 12 further comprising a trigger actuatable to move the jaws between the open jaw state and the closed jaw state, and wherein during such actuation, the trigger remains in the same orientation with respect to the handle while moving toward or away from the handle.

16. The pet waste collection device of claim 12 wherein the jaws, when moving from the closed jaw state toward the open jaw state:
a. initially move linearly in a first direction away from the handle, and
b. subsequently move in a second direction different than the first direction.

17. The pet waste collection device of claim 12 wherein the shells pass closely proximate outer portions of the jaws when the shells move toward the closed shell state, whereby if a bag has its bag mouth situated about the outer portions of the jaws closely passed by the shells, such passage by the shells will remove the bag.

18. A pet waste collection device comprising:
a. a pair of opposing jaws, the jaws having jaw ends, wherein the jaws are movable between:
i. a closed jaw state with their jaw ends proximate each other, and
ii. an open jaw state wherein the jaw ends are spaced from each other;
b. a pair of opposing shells, the shells having shell lips, wherein the shells are movable between:
i. a closed shell state with their shell lips immediately adjacent each other and with the jaws resting within the shells, and
ii. an open shell state wherein the shell lips are spaced from each other and the jaws are in the open jaw state with the jaw ends protruding from the shell lips; and
c. a handle spaced from the jaws.

19. A pet waste collection device comprising;
a. a pair of opposing jaws, the jaws having jaw ends, wherein:
(1) the jaws are movable between a closed jaw state with their jaw ends proximate each other, and an open jaw state wherein the jaw ends are spaced from each other; and
(2) the jaws include;
(a) pivot ends opposite their jaw ends, and
(b) an intermediate section between their pivot ends and jaw ends, wherein a portion of the intermediate section travels:
i. initially along a linear path in a first direction, and
ii. subsequently along a path in a second direction different from the first direction,
when the jaws move towards the open jaw state;
b. a handle spaced from the jaws; and
c. a frame maintaining the handle and jaws in spaced relation, and wherein the paths along which the portion of the intermediate section travels are defined in the frame,
wherein the jaws, when moving from their closed jaw state to their open jaw state:

i. initially move away from the handle with their jaw ends remaining proximate each other, and ii. only subsequently after a period of such movement do the jaw ends move into spaced relationship.

20. The pet waste collection device of claim 19 wherein:

a. a track is defined in the frame, the track defining the paths along which the portion of the intermediate section travels, and b. the intermediate section traveling in the paths defines a member riding in the track.

21. A pet waste collection device comprising:

a. a pair of opposing jaws, the jaws having jaw ends, wherein the jaws are movable between a closed jaw state with their jaw ends proximate each other, and an open jaw state wherein the jaw ends are spaced from each other;

b. a hane spaced from the jaws; and c. a frame, the frame including a pair of side members extending from opposing sides of the handle, wherein the jaws are slidably connected between the side members;

wherein the jaws, when moving from their closed jaw state to their open jaw state:

i. initially move away from the handle with their jaw ends remaining proximate each other, and ii. only subsequently after a period of such movement do the jaw ends move into spaced relationship.

22. A pet waste collection device comprising:

a. a pair of opposing jaws, the jaws having jaw ends, wherein the jaws are movable between a closed jaw state with their jaw ends proximate each other, and an open jaw state wherein the jaw ends are spaced from each other;

b. a pair of opposing shells wherein the jaws are situated, the shells having shell lips, wherein the shells are movable between:

i. a closed shell state with their shell lips proximate each other and with the jaws resting within the shells in the closed jaw state, and ii. an open shell state wherein the shell lips are spaced from each other and the jaws are in the open jaw state with the jaw ends protruding from the shell lips; and c. links extending between the jaws and the shells, wherein the links move the shells between their open and closed shell states when the jaws are moved between their open and closed jaw states.

23. A pet waste collection device comprising:

a. a pair of opposing jaws, the jaws having jaw ends, wherein the jaws are movable between a closed jaw state with their jaw ends proximate each other, and an open jaw state wherein the jaw ends are spaced from each other;

b. a pair of opposing shells wherein the jaws are situated, the shells having shell lips, wherein the shells are movable between:

i. a closed shell state with their shell lips proximate each other and with the jaws resting within the shells in the closed jaw state, and ii. an open shell state wherein the shell lips are spaced from each other and the jaws are in the open jaw state with the jaw ends protruding from the shell lips, and wherein the shells pass closely proximate outer portions of the jaws when the shells move toward the closed shell state, whereby if a bag has its bag mouth situated about the outer portions of the jaws closely passed by the shells, such passage by the shells will remove the bag.

* * * * *